United States Patent [19]

Stickler

[11] 4,301,847

[45] Nov. 24, 1981

[54] ATTACHMENT FOR CONICAL WOODSPLITTER

[76] Inventor: Arthur C. Stickler, 321 N. 8th St., Gunnison, Colo. 81230

[21] Appl. No.: 105,730

[22] Filed: Dec. 20, 1979

[51] Int. Cl.[3] ..... B27L 7/00

[52] U.S. Cl. ..... 144/194; 254/104; 411/411

[58] Field of Search ..... 144/193 R, 193 B, 193 C, 144/193 D, 194; 254/104; 145/116 R, 124; 151/41.73; 411/71, 72, 411

[56] References Cited

U.S. PATENT DOCUMENTS

| | | | |
|---|---|---|---|
| 741,983 | 10/1903 | Skward | 411/72 |
| 953,162 | 3/1910 | Weinberg | 144/193 R |
| 1,655,808 | 1/1928 | Bodkin | 411/72 |
| 4,091,851 | 5/1978 | Ober | 144/193 R |
| 4,188,987 | 2/1980 | James | 144/194 |

FOREIGN PATENT DOCUMENTS

| | | | |
|---|---|---|---|
| 2622072 | 12/1976 | Fed. Rep. of Germany | 144/193 R |
| 1120159 | 4/1956 | France | 144/194 |

OTHER PUBLICATIONS

Chain Saw Industry & Power Equipment Dealer, "The Stickler", p. 32, Oct. 1976.

*Primary Examiner*—W. D. Bray

*Attorney, Agent, or Firm*—Gary M. Polumbus

[57] ABSTRACT

An attachment for a conical woodsplitter comprises a rigid body having an outwardly radially diverging surface and a threaded tapered hole extending along its longitudinal axis adapted to be threadedly mated with the conical woodsplitter.

1 Claim, 4 Drawing Figures

ATTACHMENT FOR CONICAL WOODSPLITTER

BACKGROUND OF THE INVENTION

1. Field of the Invention

This invention broadly relates to a woodsplitting device and more particularly, to an attachment for a conically-shaped screw-type woodsplitting device.

2. Brief Description of Prior Art.

In the past, various types of manual devices have been utilized to split wood such as logs, boards or the like. For example, a simple metal wedge is held in one hand of the operator and is pounded into a log with a hammer held by the other hand of the operator which, in turn, causes the wood fibers to separate until the log splits into two pieces. Another manual woodsplitting device is a combination ax and wedge. This is simply a modified ax having a wedge-type head for an operator to strike with a hammer after the ax portion of this device is embedded into the wood.

Recently, an automatic device has been developed for splitting wood. This device comprises a conically-shaped screw that is rigidly attached to an adapter plate and can be bolted onto an engine-driven wheel of a vehicle such as a pick-up truck, car or the like. While one end of the log maintains contact with the ground surface, the other end of the log is pressed against the rotating screw so that the screw begins to penetrate the log. As the penetration of the screw deepens, the conical shape of the screw forces the log to split. However, quite often, the maximum diameter of the conically-shaped screw is insufficient to split the log completely usually because wet wood pulp fibers tend to resist splitting or because the log itself is simply too large in diameter for the conical screw to effectively split the log. As a result, the operator of the woodsplitting device must stop the rotation of the woodsplitter, remove the partially split log, and either complete the splitting by hand or attempt to utilize the conically-shaped screw-type woodsplitter again by pressing the log against the rotating screw at a point directly opposite to the first point of penetration. These inherent disadvantages of having to stop the rotational device and to pry the partially split log from the screw results in wasted time, wasted manual effort, and an overall decrease in operating efficiency.

It is from these considerations and others that the present invention has evolved. As a result of the present invention, the maximum splitting diameter of the conical screw of the woodsplitter has been significantly increased to solve the problem of producing partially split wood. Furthermore, the attachment is easily affixed to the conically-shaped screw and is simple and inexpensive to manufacture.

SUMMARY AND OBJECT OF THE INVENTION

The principal object of the present invention is to provide an apparatus that can enhance the woodsplitting capability of a conically-shaped screw-type woodsplitter.

Another object of the invention is to provide an apparatus that is easily attachable to a conically-shaped screw-type woodsplitter.

A further object of the invention is to provide an apparatus that can provide additional pulling capability for a conically-shaped screw-type woodsplitter.

Still further, a related object of the invention is to provide an inexpensive apparatus that can be affixed to a conically-shaped screw-type woodsplitter without any modification or alteration to the design of the woodsplitter.

In accordance with the objects of the invention, the attachment for a conically-shaped screw-type woodsplitter is essentially a frusto-conically shaped device formed from a hardened material such as steel, cast iron or a type of structural plastic. A tapered hole is formed along the longitudinal axis of the frusto-conically shaped apparatus and is tapered and threaded in order to intermesh with the threads on a portion of a conventional conically-shaped screw-type woodsplitter near the maximum diameter of the conically-shaped screw. The outer conical surface of the present invention is also threaded to provide a continuous screw action of the woodsplitter but at a greater angle of inclination. At least one or more recesses may be found within the base of the attachment to facilitate the removal of the attachment from the conically-shaped screw such as by inserting a screwdriver or the like into a recess and hammering in a direction for unscrewing the attachment from the conically-shaped screw of the woodsplitter.

DESCRIPTION OF THE PREFERRED EMBODIMENT

Figure 1:
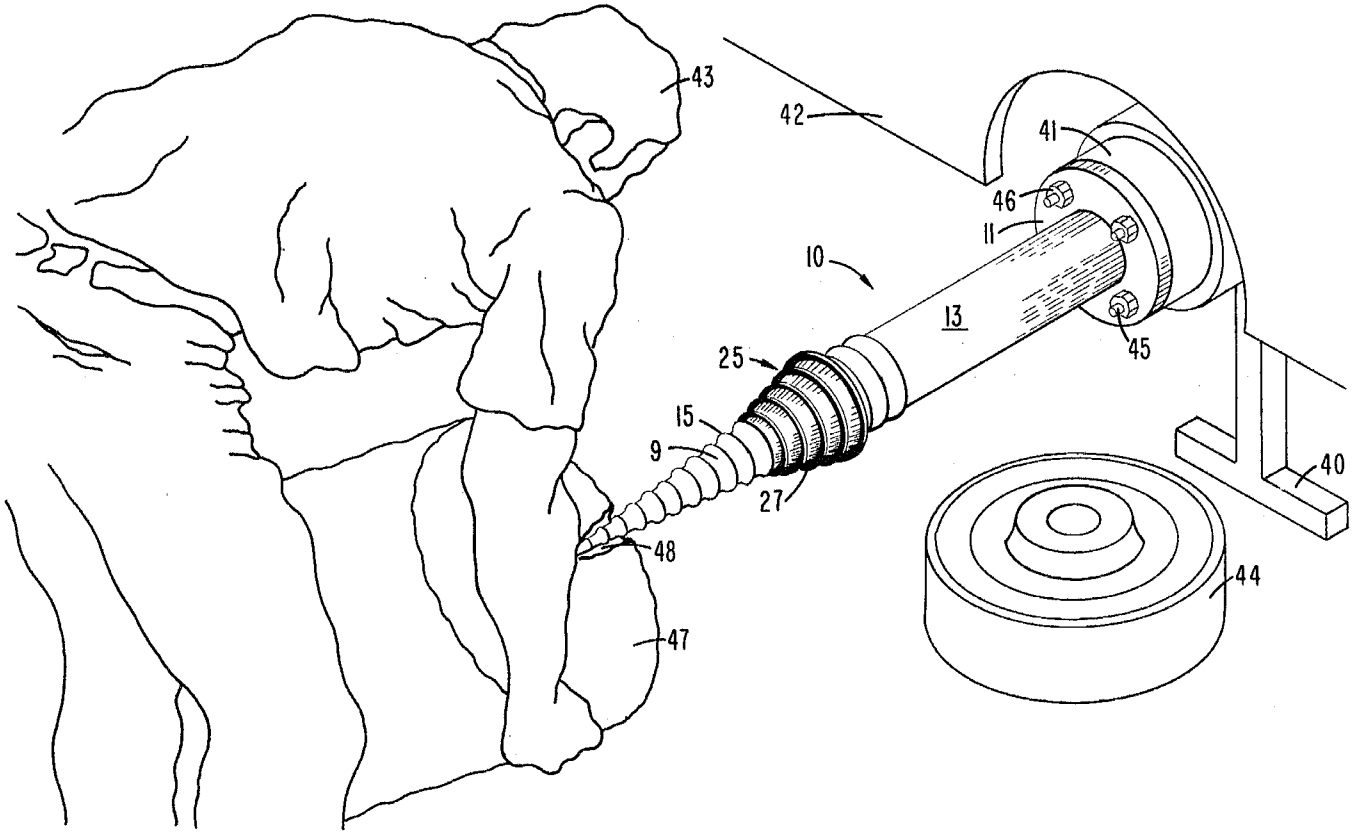
FIG. 1 is a perspective view illustrating the operation of a screw-type conical woodsplitter including its attachment affixed thereto.
Figures 2, 3, 4:
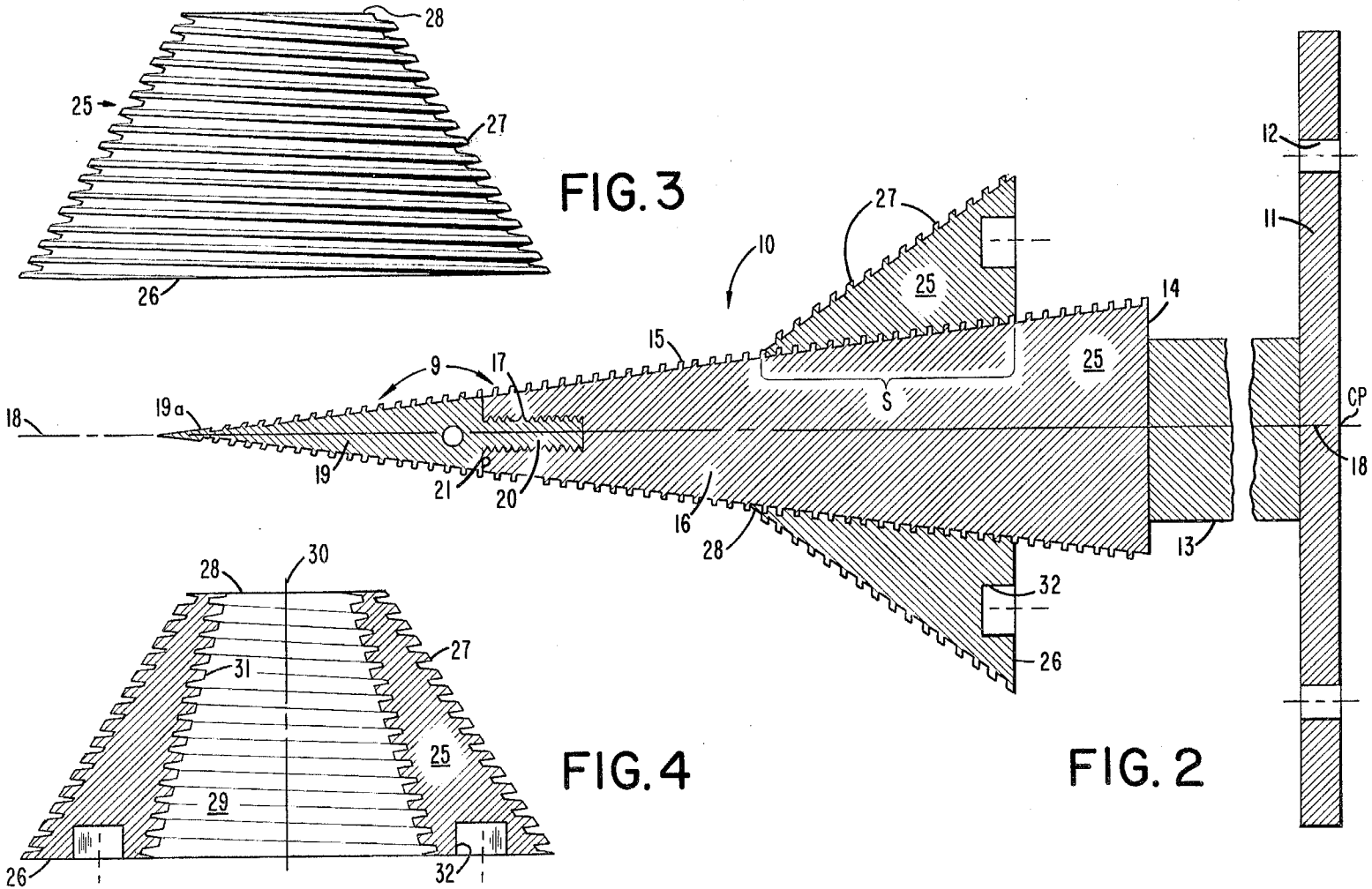
FIG. 2 is an axial, cross sectional view illustrating the attachment affixed to a conically-shaped screw-type woodsplitter.
FIG. 3 is an elevational view of the attachment for a conically-shaped screw-type woodsplitter.
FIG. 4 is a cross sectional, elevational view of the attachment for a conically-shaped screw-type woodsplitter.

A preferred embodiment of an attachment 25 of the present invention is shown in FIGS. 1 and 2 releasably affixed to a screw assembly 9 of a conventional conically-shaped screw-type woodsplitter 10.

As shown in FIG. 2, the typical woodsplitter 10 of the type adapted to receive the attachment of the present invention includes an adapter plate 11 having a plurality of prearranged holes 12, a conically-shaped screw assembly 9 and an extension 13 rigidly attaching a base 14 of the screw assembly 9 to the adapter plate 11. The conically-shaped screw assembly 9 is a conical body having a penetrating thread 15, formed into its outer surface and can be either a unitary structure or, as FIG. 3 illustrates, two interconnecting components. One component is a frusto-conically shaped screw 16 being rigidly attached to the extension 13 at the screw assembly base 14 and having a threaded hole 17 extending into the leading end of the screw 16 along the longitudinal axis 18 of the woodsplitter 10. The second component is a conical screw 19 having a pointed tip 19*a*, and a threaded stud 20 rigidly attached and extending axially from a conical screw base 21 for releasably attaching the conical screw 19 to the frusto-conically shaped screw 16.

As also seen in FIG. 2, the adapter plate 11 contains a plurality of circumferentially spaced holes 12 that are disposed equidistant with respect to each other and with respect to a center point CP located on the adapter plate so that the holes 12 correspond with the lug-bolt pattern of a conventional automotive vehicle wheel. The extension 13 rigidly interconnects the adapter plate 11 with the conical screw assembly 9 such that the center point CP coincides with the longitudinal axis 18 of the conical screw assembly 9. As a result, the arrangement of the holes 12 within the adapter plate in conjunction with the alignment of the center point CP with the longitudinal axis of the conical screw assembly facilitates the transference of rotational movement from a rotational source to the woodsplitter about its longitudinal axis 18. Thus, the longitudinal axis 18 of the woodsplitter functions as the rotational axis for the woodsplitter.

As shown in FIG. 3 attachment 25 of the present invention is a frusto-conically shaped body which is preferably formed from a hardened material such as steel. The frusto-conically shaped body has a base or trailing end 26 with a diameter approximately two times larger than the diameter of the base 14 of the screw assembly 9. For example, the diameter of the base end 26 of the preferred embodiment of the attachment 25 is eight inches and the diameter of the base 14 of the screw assembly 9 is four inches. An outer helical thread 27 is formed in the outer conical surface beginning at a leading end 28 of the attachment and ending at the base end 26. As shown in FIG. 4, a hole 29 extends through the attachment along its longitudinal axis 30 and is tapered in a direction to approximately coincide with the outer conical surface of the attachment 25. Inner threads 31 are formed within the tapered hole 29 of attachment 25 to threadably mate with the penetrating thread 15 of the screw assembly 9. Four recesses 32 are formed in the base end 26 of the attachment to facilitate the removal of the attachment 25 from the woodsplitter 10 by inserting an instrument such as a screwdriver into the recess 32 and striking the instrument with a hammer in the direction to unscrew the attachment from the screw assembly.

With reference again to FIG. 2, attachment 25 is removably affixed to screw assembly 9 by intermeshing the inner threads 31 of the attachment with the penetrating thread 15 of the screw assembly along a portion of the screw assembly 9 designated S. Thus, an operator can easily position the attachment near portion S of the screw assembly, then rotate the attachment to intermesh the inner threads 31 of the attachment with the penetrating thread 15 of the screw assembly thereby securely fastening the attachment onto the screw assembly. Once the attachment is fastened to the screw assembly, the outer threads 27 of the attachment 25 converge toward the penetrating thread 15 of the screw assembly to form a substantially continuous relationship with the penetrating thread 15. This continuous threading enables the attachment to grip the wood after it has advanced along the screw assembly and thereby facilitate the splitting of logs.

The operation of the attachment 25 of the present invention is best illustrated by reference to FIG. 1 wherein a stand 40 supports an engine driven hub 41 of a vehicle 42 such as a pick-up truck, car or the like above the ground surface so that an operator 43 can remove the wheel 44 and replace it with the woodsplitter 10. The operator mounts the woodsplitter onto the engine driven hub 41 by aligning the lugs 45 of the hub with the holes 12 in the adapter plate, sliding the adapter plate onto the lugs 45 and fastening the woodsplitter onto the lugs with nuts 46. The operator then starts the engine (not shown) and engages the transmission (not shown) into gear to cause engine driven hub 41 to rotate which in turn rotates the woodsplitter 10 about its longitudinal axis 18. As the woodsplitter rotates, the operator presses a log 47 against the tip 31*a* of the screw assembly and sets the other end of the log on the ground surface. The rotation of the woodsplitter causes the penetrating thread of the screw assembly to continuously penetrate the log. As the screw assembly continues to penetrate the log, the conical shape of the screw assembly forces wood fibers (not shown) of the log to tear more and more until finally the log splits into pieces.

Often, the diameter of the screw assembly base 14 is insufficient to completely split the log. Having the attachment affixed to the woodsplitter effectively increases the diameter of the screw assembly 14 to greatly enhance the woodsplitting capability of the woodsplitter. This is achieved when the split surfaces 48 of the log contact the attachment. The conical shape of the attachment having a larger diameter base end 26 than the screw assembly base 14 forces the split surfaces further and further apart at a higher incremental rate as the screw assembly continues to penetrate the log. Also, as the attachment forces the split surfaces apart, the outer helical thread 27 of the attachment tends to bite into the split surfaces of the log to aid the penetration action of the screw assembly. Upon the completion of the woodsplitting operation, the attachment may be unscrewed from the screw assembly of the woodsplitter and the woodsplitter is removed from the engine driven hub and replaced with the wheel. Although the present invention has been described with a certain degree of particularity, it is understood that the present disclosure has been made by way of example and that changes in details of the structure may be made without departing from the spirit thereof.

I claim:

1. In an improved woodsplitter device including a conically threaded screw having a tip and a base, said screw being rigidly attached to an adapter plate that is removably attachable to an engine-driven wheel of an automotive vehicle for imparting a rotational movement to said woodsplitter, wherein the improvement comprises: a frusto-conically shaped externally threaded body defining an outer frusto-conical surface and having a flat base surface and an internally threaded hole extending axially through said body, said hole being tapered to define an inner frusto-conical surface, said outer frusto-conical surface converging axially toward said inner frusto-conical surface so as to approximately coincide with said inner frusto-conical surface and said body hole adapted to fit over the tip of said screw, said body threadably connected to a portion of said conically threaded screw in a meshed relationship.

* * * * *